United States Patent [19]

Mäki-Rahkola et al.

[11] Patent Number: 5,020,961

[45] Date of Patent: Jun. 4, 1991

[54] TRANSFER CAR

[75] Inventors: Jari Mäki-Rahkola, Kauhajoki; Juhani Könönen; Jorma Surakka, both of Hyvinkää, all of Finland

[73] Assignee: Insinooritoimisto Pesmel Oy, Kauhajoki, Finland

[21] Appl. No.: 455,300

[22] Filed: Dec. 22, 1989

[30] Foreign Application Priority Data

Jan. 4, 1989 [FI] Finland ..... 890038

[51] Int. Cl.[5] ..... B60P 1/02

[52] U.S. Cl. ..... 414/495; 280/43.13; 414/911; 187/8.72

[58] Field of Search ..... 414/495, 910, 911; 187/8.72, 8.71, 18; 280/43.13; 254/10 R, 10 B, 10 C

[56] References Cited

U.S. PATENT DOCUMENTS

| | | | |
|---|---|---|---|
| Re. 14,839 | 4/1920 | Stuebing | 254/10 C |
| 1,291,146 | 1/1919 | Reuter | 254/10 B |
| 2,161,659 | 6/1939 | Shepard, Jr. et al. | 254/10 C |
| 3,240,506 | 3/1966 | McMullen | 414/495 X |
| 4,106,634 | 8/1978 | Becker | 414/495 |
| 4,863,335 | 9/1989 | Herigstad et al. | 414/495 |

FOREIGN PATENT DOCUMENTS

| | | | |
|---|---|---|---|
| 2223949 | 4/1980 | Fed. Rep. of Germany | 414/495 |
| 684832 | 7/1930 | France | 254/10 C |
| 1299096 | 6/1962 | France | 414/495 |

*Primary Examiner*—Robert J. Spar
*Assistant Examiner*—Robert S. Katz
*Attorney, Agent, or Firm*—John P. White

[57] ABSTRACT

The invention relates to a transfer car for heavy loads, a car which has a chassis frame (1) moving on wheels (2) and having a raisable flatbed (3) on top of it, in which an axle (4'), mounted with bearings to the chassis frame and locked to one of the two wheel pairs, is coupled by power transmission means (5'') to a transfer motor (6'), for transferring the car, and which additionally has a lever mechanism (7), connected to the flatbed (3), turning on transverse axles primarily in the forward and back ends and coupled to a raising motor (6') by a power transmission (5'), for raising and lowering the flatbed (3). In prior-art transfer cars it has not been possible to exploit the car-transfer mechanism in any way in the load-raising mechanism. Thus the transfer cars for loads such as paper rolls have so far been of a complicated structure and expensive. In the present invention, synergy has been produced between the raising and trasfer mechanisms by fitting the lever mechanism (7) to turn on the axis (4', 4'') of the two wheel pairs (2), being freely rotatably mounted with bearings (8) at least on that axle (4') which is locked (9) to its wheel pair (2).

7 Claims, 6 Drawing Sheets

TRANSFER CAR

Figure 1:
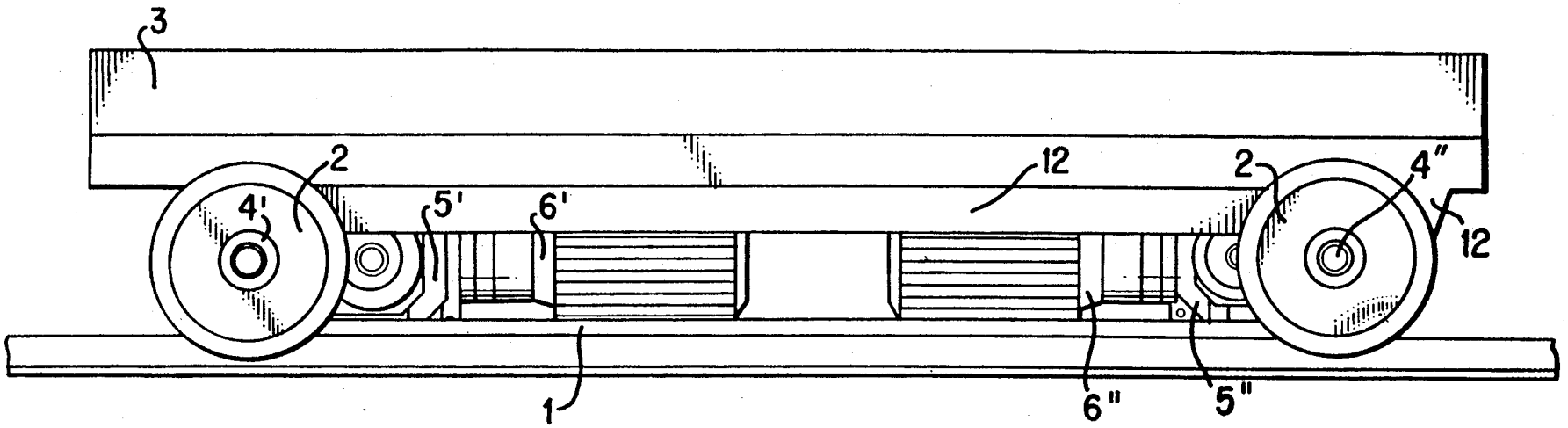

The invention relates to a transfer car which has a chassis frame moving on wheels and having a raisable flatbed on top of it, in which an axle, mounted with bearings to the chassis frame and locked to one of the two wheel pairs, is connected by power transmission means to a transfer motor, and which additionally has a lever mechanism, connected to the flatbed, turning on transverse axles primarily in the forward and back ends of the chassis frame and connected to the raising motor by power transmission means, for raising and lowering the flatbed.

Transfer cars for larger loads such as paper rolls, having at the same time a load-raising mechanism, have so far been operated by complicated compressed-air, hydraulic and shear mechanisms. In these state-of-the-art raising systems it has not been possible in any way to exploit the transfer mechanism of the car itself. Therefore the transfer cars for loads such as paper rolls have thus far been complicated by their structure and have been expensive.

The object of the present invention is to provide a transfer car the transfer mechanism of which is exploited for producing the raising effect. The aim is thus to produce synergy between the transfer mechanism and the raising mechanism, which will lead to a more practical and thereby less expensive transfer-car system than previously.

The object of the present invention is achieved by means of a transfer car which has a chassis frame moving on wheels and having a raisable flatbed, and in which an axle, supported on bearings in the chassis frame and locked to one of the wheel pairs, is connected by power transmission means to the transfer motor, for transferring the car. The car also has a lever mechanism, which connected to the flatbed, turns on transverse axles primarily in the forward and back ends of the chassis frame, and is connected to the raising motor by power transmission means, the flatbed being raised and lowered by the lever mechanism. According to the invention, the transfer car is characterized in that the lever mechanism is fitted so as to turn on the axles of the two wheel pairs, being supported freely rotatably on bearings on at least that axle which is locked to its wheel pair. Thus the axle of each of the wheel pairs is exploited as an axle of the levers raising the flatbed.

The raising motor driving the lever mechanism may be coupled either so that the raising force is transmitted to the levers mounted on both axles, or so that the raising motor acts on only the lever mounted on one axle. In the latter case the wheel pair of the said one axle is mounted freely rotatably on bearings on its axle, whereas the lever mechanism is locked to it and the raising motor is connected to it. When the raising motor in this manner acts on only one lever to raise the flatbed, rigid members between the levers are needed for transmitting the raising force to the other lever, which is mounted freely rotatably on the other axle of the car.

The lever mechanism in which the raising motor acts on only one axle and on the lever locked to it and the torque is transmitted to the levers mounted freely on bearings on the other axle is advantageously made up of discs which are articulated to each other by two longitudinal connecting rods one above the other and are fitted to bear on the axle of each wheel pair, and of members for converting their rotary movement into a raising movement. The levers are thus formed of discs rotating on the two axles of the car and the lever mechanism is formed of a parallelogram mechanism built on the discs, the corner points of the parallelogram consisting of the center points of the car axles and the articulation points on the parallel radii of the said discs, the longitudinal connecting rods being connected to the articulation points. When the raising motor rotates one axle and the disc locked to it, also the disc mounted on the other axle will rotate owing to the connecting rods. Thereupon the articulation points of both discs, together with the connecting rods, will raise upwards and one of the connecting rods will at the same time raise the flatbed and its load.

The discs must be connected by two adjacent longitudinal connecting rods, one above the other, in order that the said parallelogram mechanism should not at the transition points, where all the members are parallel, be converted to an anti-parallelogram mechanism, in which case the discs would tend to rotate in opposite directions. This is a risk especially when the raising motor is suddenly switched on to raise a heavy load while the center points and articulation points of the discs serving as levers are on substantially the same straight line. Thus there is needed, for each pair of discs on the same side of the car, two connection rods articulated to the discs. By means of these, parallel parallelogram mechanisms are formed which do not reach their transition positions simultaneously. It also follows from the nature of the problem that the articulation points of the connecting rods in each disc are preferably at a phase angle of 90 degrees relative to each other.

The transfer car can be simplified further by situating the power transmission means with their motors between the axles of the wheel pairs of the car, on a straight line parallel to the longitudinal direction of the chassis frame, preferably on its center line. In this case the raising and transfer functions can be combined so that they are carried out by one and the same motor, which, being between the wheels and the power transmission means of the flat-lever mechanism, can be electively connected to either one. The raising movement of the transfer car is usually even, i.e. all of the sides of the flatbed are raised by an equal amount by the raising movement. In this case the transfer car has preferably two lever mechanisms fitted symmetrically on both sides of the chassis frame. In this embodiment the transfer mechanisms of the transfer car are exploited to their full extent for raising the flatbed.

Figure 2:
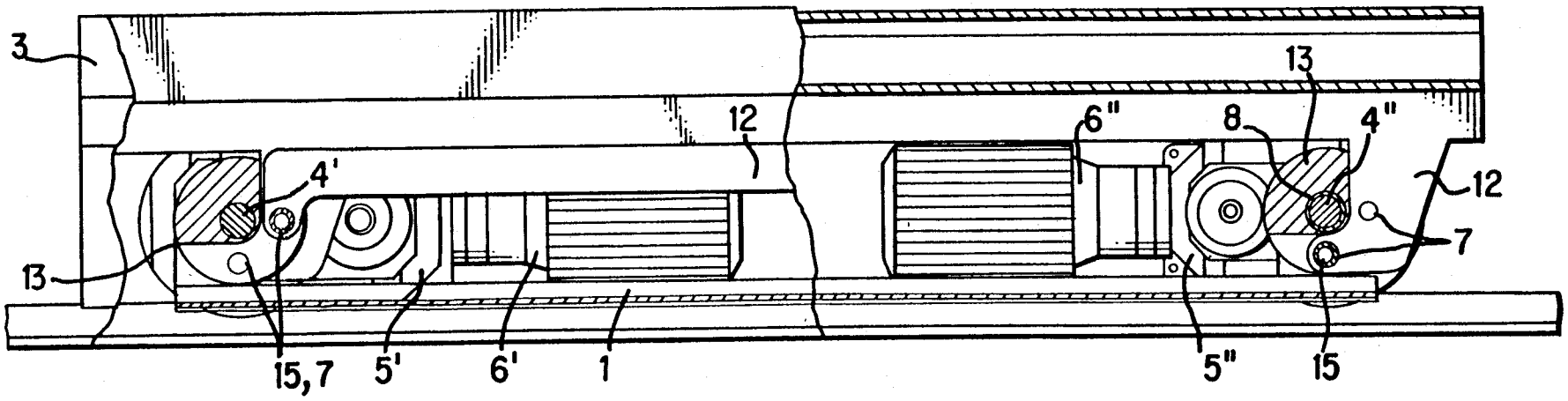
Figure 3:
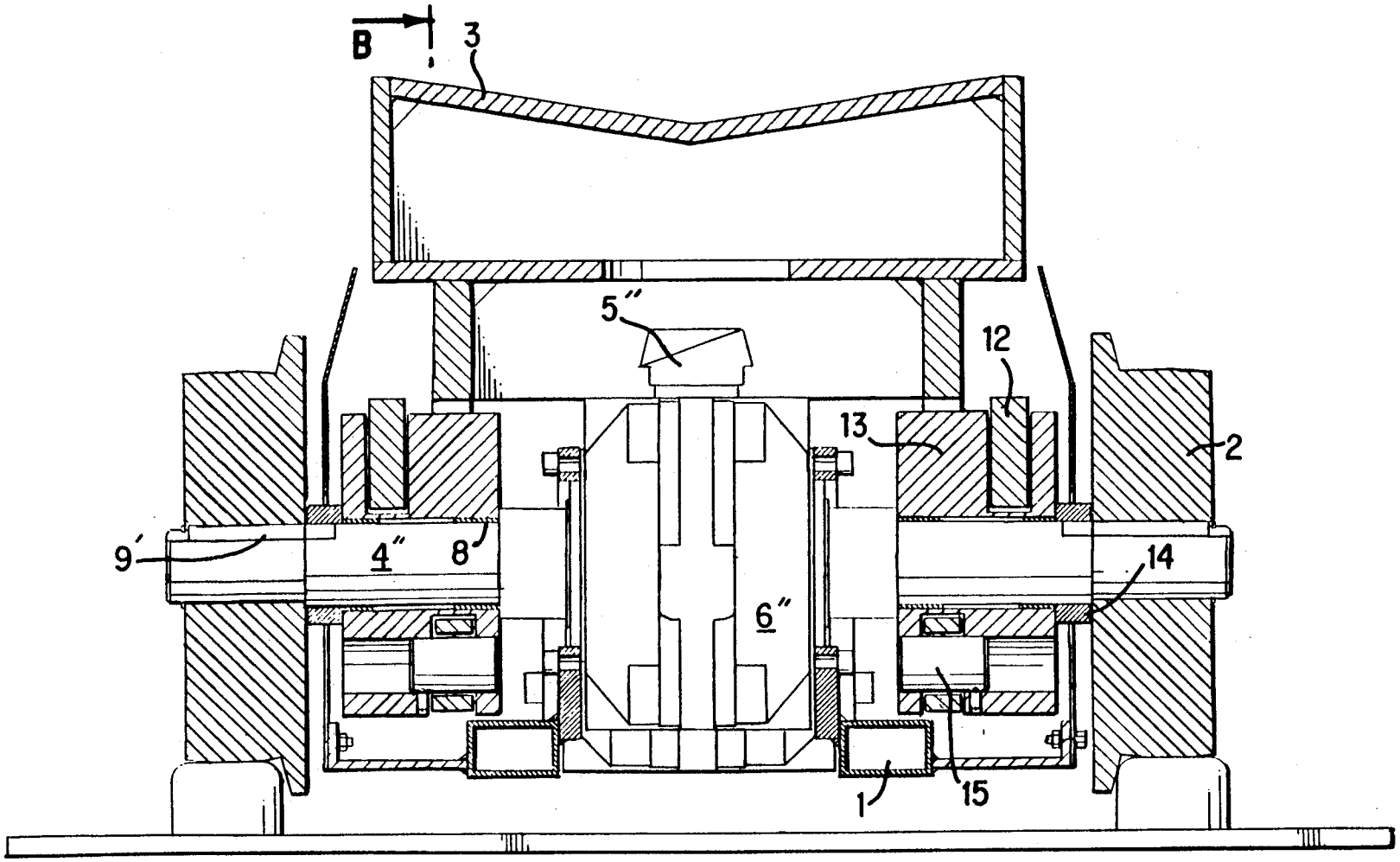
Figure 4:
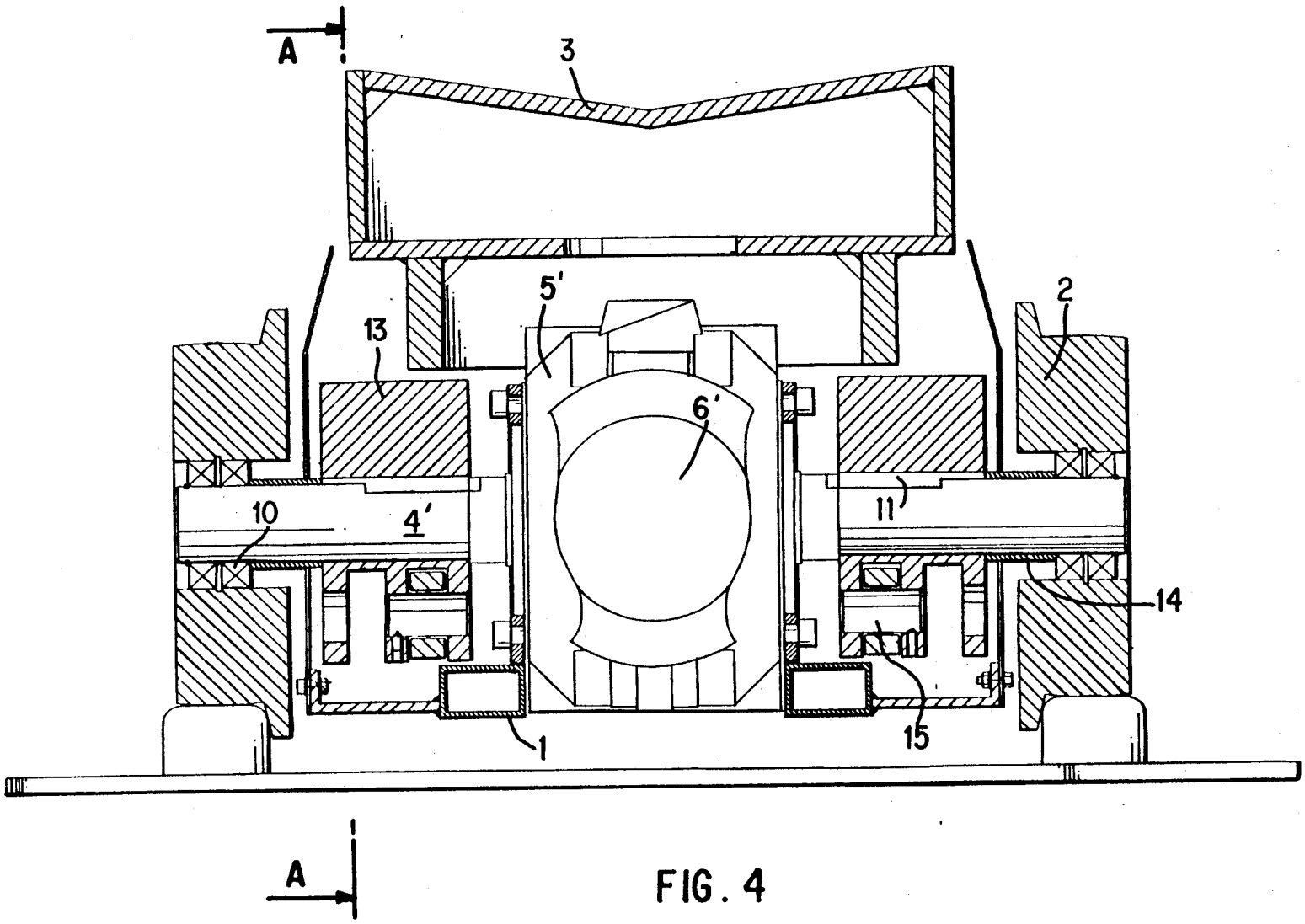
Figure 5:
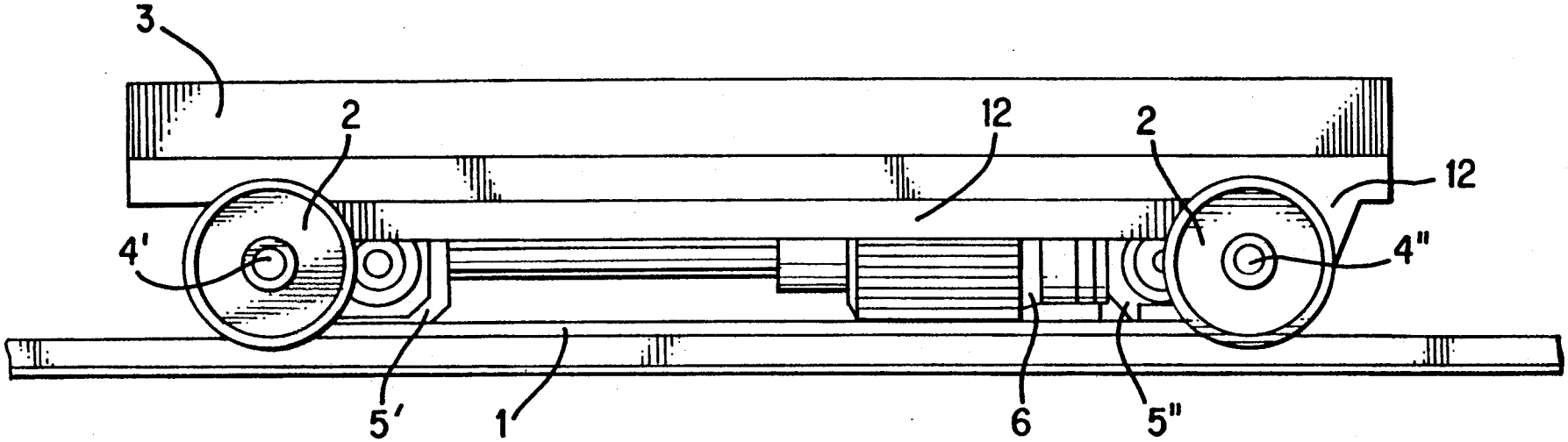
Figure 6:
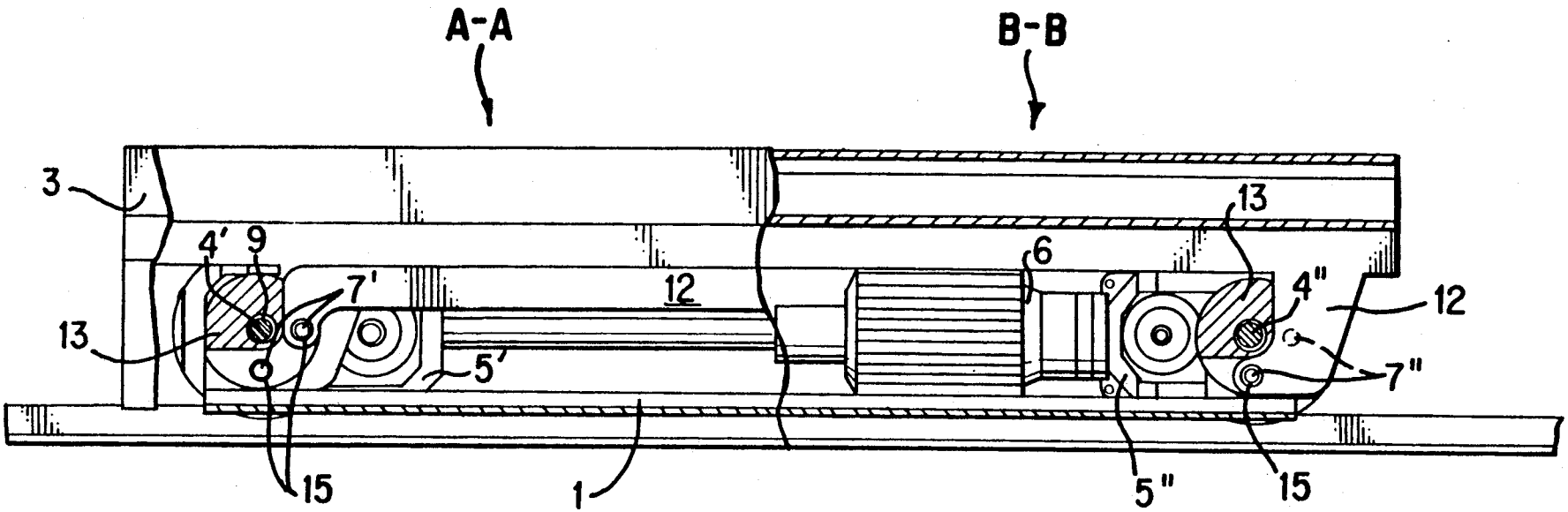

The invention is described below in greater detail with reference to the accompanying drawings, in which FIG. 1 depicts a side elevation of a transfer car according to one embodiment of the invention, FIG. 2 depicts a transfer car according to FIG. 1, with two partial sections, which are indicated in FIGS. 3 and 4, FIG. 3 is a cross sectional representation of the transfer car according to FIG. 2, through the wheel axle seen on the left in the figure, and FIG. 4 is a cross sectional representation of the transfer car according to FIG. 2, through the wheel axle seen on the right in the figure, FIG. 5 depicts a side elevation of a transfer car according to one embodiment of the invention, and FIG. 6 depicts a transfer car according to FIG. 5, with two partial sections.

The transfer car depicted in FIG. 1 comprises a chassis frame 1 moving on wheels 2, with a raisable flatbed 3 on top of it. To the chassis frame 1 at the right-hand-side end of FIG. 1 there is mounted on bearings an axle 4", which is locked to one wheel pair 2 and is coupled by power transmission means 5" to the transfer motor 6" which transfers the car. The transfer-car wheel pair 2 shown in the left-hand-side end of FIG. 1 is mounted freely rotatably on an axle 4'. A raising motor 6' is locked via power transmission means 5' to axle 4'. The axle 4' is also locked to the lever mechanism which raises the flatbed 3, the lever mechanism being hidden under the wheel 2 in the figure.

On the left in FIG. 2 there is shown a partial section, indicated by A—A in FIG. 4, of the transfer-car raising mechanism. The raising mechanism comprises a raising motor 6', which is via power transmission means 5' coupled to the axle 4'. On axle 4' there is freely rotatably mounted a transfer-car wheel (on the viewer's side of section A—A) and inside it there is concentrically fitted a disc 13, which is, however, locked. In the disc 13 there are provided articulation points 15 for two longitudinal connecting rods 12, one above the other, the upper one of them supporting the flatbed 3. The connecting rods 12 are in the same manner connected to the disc 13 depicted on the right in the figure, so that the discs 13 and the connecting rods 12 together form a parallelogram mechanism.

On the right in FIG. 2 there is shown a partial section, indicated by B—B in FIG. 3, depicting that side of the car on which the transfer motor 6" acts. This transfer motor 6" is coupled by power transmission means 5" to the axle 4". On the axle 4" there are mounted and locked the transfer-car wheels (on the viewer's side of section B—B), which then drive the car in the desired direction. A disc 13 acting as a raising lever is mounted on the axle 4" concentrically inside the wheel, but so as to rotate freely. This disc moves freely on bearings in relation to the axle 4". This disc, also, has, as mentioned above, articulation points 15 for two longitudinal connecting rods 12, which are one above the other.

As was mentioned above, the disc 13, coupled to the raising motor 6' and seen on the left in FIG. 2, and the freely rotating disc 13 on the right in the same figure from, with their articulation points 15 and connecting rods 12, two parallel parallelogram mechanism in order that the parallelogram mechanism should not arrive at a so-called dead point when the disc is rotated. The connecting rods are both bent upward to move horizontally so that they are one above the other and also so that the upper one of them supports the flatbed 3 from below.

FIG. 3 shows a section through the axle 4" of the wheel pair visible on the right in the above figures. It shows the beams 1 of the chassis frame of the transfer car, the said wheel-pair axle 4", the wheels 4, and the raisable flatbed 3. In the center there is the transfer motor 6", which is by mediation of the power transmission means 5" coupled to the axle 4", which is mounted with bearings to the chassis frame of the car. What is in question is the car transfer mechanism, so that the axle 4" is locked to the wheel pair 2 of the car.

While the transfer motor 6" rotates the axle 4" with the wheel pair 2 locked to it with a cotter pin 9, a lever mechanism has been mounted, independently of the transfer movement, on the same axle 4". It is based on the disc 13, which is mounted with bearings 8 freely rotatably on the said axle 4". In the disc 13 there are provided, by embedding eccentrically, articulation points, of which only one 15 is seen in FIG. 3. At the articulation point 15 visible in the figure there is then mounted the upper connecting rod, indicated by numeral 12 on the lower right-hand side in FIG. 1, the rod supporting the flatbed 3 from below. To the same disc 13 there is also articulated a lower connecting rod 12, below the plane of the section, and thus not visible in the figure, in such a manner that its articulation point is in the horizontal plane of the axle 4". The lower connecting rod 12 is embedded in the disc at a point so much outward in the longitudinal direction of the axle 4" from the upper connecting rod that during the lever movement the connecting rods will not come into contact with each other and also this lower and outer connecting rod will not come into contact with the flatbed 3. The latter connecting rod, indicated by numeral 12, is seen in the figure and is partly embedded in the disc 13.

FIG. 4 shows a section through the axle 4' of the wheel pair visible on the left in FIG. 2. It also shows the beams 1 of the transfer-car chassis frame, the axle 4' of the said wheel pair, the wheels 2, and the raisable flatbed 3. In the center there is the raising motor 6', which is by the mediation of the power transmission means 5' coupled to the axle 4', which is mounted with bearings to the chassis frame of the car. Since what is in question is the raising mechanism of the car, the wheel pair 2 in this figure is mounted with bearings 10 freely rotatably on the axle 4'. The raising motor 6' with its power transmission means 5' is coupled to the axle 4'. The lever mechanism is locked to the axle 4'. Thus, when the raising motor 6' rotates the not axle 4', the lever mechanism raises the flatbed but does not rotate the wheels 2. The lever mechanism is based on the disc 13, which is locked, for example by using a cotter pin 11, to the axle 4'. By eccentric embedding there is provided in the disc two articulation points, of which only one 15 is visible in FIG. 4. At that articulation point there is mounted with bearings the upper connecting rod, indicated by numeral 12 on the lower right-hand side in FIG. 1, the rod supporting the flatbed 3 from below.

Also articulated to the disc 13 there is, not visible in the figure, the lower connecting rod 12, in such a manner that its articulation point is in the plane of the axle 4' and at the same embedded in the disc at a point so much outward in the longitudinal direction of the axle 4' from the upper connecting rod that the connecting rods will not come into contact with each other and this lower and outer connecting rod 12 will also not come into contact with the flatbed 3. The embedding groove of the latter connecting rod 12 is in the disc 13 below the rotation axle, directly outward in the longitudinal direction of the axle from the articulation point 15. Since section A—A runs exactly through this embedding, it is visible in FIG. 2 on the left as the unhatched area of the disc 13. The width of the embedding groove corresponds to the width of the connecting rod 12 and its extent corresponds to the segment which the lower connecting rod covers, as seen from the side of the car, when the disc 13 is being rotated around its axis. It is evident from FIG. 2 that the groove has been designed for turning the disc from the depicted position through 180 degrees counterclockwise.

The transfer car according to the invention operates so that the transfer motor 6" transfers car, with the aid of the power transmission means 5", the axle 4" and the wheels 2 locked to the axle, at the desired speed, in the desired direction. Since the disc 13 of the lever mechanism 7', 7" is mounted freely rotatably on this axle 4", the transfer of the car takes place independently of the raising of the load.

The raising is carried out by using the raising motor 6' so that it, together with its power transmission means, is connected to one axle 4'' of the car and the discs 13 locked to it. These and the discs 13 at the other end of the car have articulation points 15 provided symmetrically on both sides, and between the articulation points two longitudinal connecting rods 12 one above the other. The axles 4, 4', the discs 13, the articulation points 15, the chassis frame 1 and the connecting rods 12 form a parallelogram mechanism with the help of which, with the use of torque acting on only one disc, the raising of the flatbed 3 can be effected by using the upper connecting rod which supports it from below. Since there is no locking between the axle 4' coupled to the raising motor 6 and the wheels 2 on it, the car can move completely independently of the raising of the flatbed. Thus the axles of the wheel pairs of an ordinary transport car are used in an excellent manner for producing a raising mechanism for a transfer car. There thus prevails synergy between the transfer mechanism and the raising mechanism of the car. The transfer car shown in FIGS. 5 and 6 comprises a chassis frame 1 moving on wheels 2, with a raisable flatbed 3 on top of the chassis frame 1. The transfer car has a first axle 4'', which is locked to one wheel pair 2 and is coupled by first power transition means 5'' to a motor 6, which serves both as a transfer motor and a raising motor. The wheel pair 2 shown on the left-hand side of FIG. 5 is mounted to freely rotate on second axle 4'. The transfer and raising motor 6 is connected via a second power transmission means 5' to second axle 4'. The second axle 4' is also locked to a first lever mechanism 7', shown in FIG. 6, which raises the flatbed 3 and the first axle 4'' is locked to a second lever mechanism 7''.

We claim:

1. A transfer car which has a chassis frame (1) moving on first and second pairs of wheels (2) rotatably supported by respective first and second transverse axles and having a raisable flatbed (3) thereon, in which said first axle (4'') mounted with bearings to the chassis frame and locked to said first wheel pair, is coupled by a first power transmission means (5'') to a transfer motor (6, 6'') for horizontally transferring the car, and which additionally has a first lever mechanism (7'), turning on said transverse axles and coupled to a raising motor (6, 6') by a second power transmission means (5'), for raising and lowering the flatbed (3) with respect to said chassis frame (1), characterized in that the first lever mechanism (7') is fitted to turn, supported by the axles (4', 4'') of the two wheel pairs (2), being mounted freely rotatable with bearings (8) at least on said first axle (4'') which is locked (9) to said first wheel pair (2).

2. A transfer car according to claim 1, characterized in that said second of said first and second pairs of wheels (2) is freely rotatably mounted with bearings (10) on said second axle (4''), said first lever mechanism (7') being locked (11) and the raising motor (6') having said second power transmission means (5') being coupled to this axle (4').

3. A transfer car according to claim 1 or 2, characterized by lever mechanism (7', 7'') both said first (7') and said second lever (7'') mechanism being symmetrically fitted on opposite sides of the chassis frame (1).

4. A transfer car according to claim 3, characterized in that each of said first (7') and said second lever mechanism (7''), comprises two discs (13) articulated to each other with two longitudinal connecting rods (12), one above the other coupled to said discs and fitted to bear on said first and second axles, (4', 4'') of each wheel pair, and by means (14) for converting the rotational movement of said discs into a raising movement.

5. A transfer car according to claim 4, characterized in that articulation points (15) of the connecting rods (12) on each disc (13) are at a phase angle of 90 degrees in relation to each other.

6. A transfer car according to claim 1, characterized in that said first power transmission means (5'') coupled to said transfer motor (6'') and said second power transmission means (5') coupled to said raising motor (6') are fitted between the first and second axles (4', 4'') of the wheel pairs, successively on a straight line in the longitudinal direction of the chassis frame (1).

7. A transfer car according to claim 1, characterized in that the raising motor and the transfer motor are one and the same motor (6), said motor (6) is located between the first and second pairs of wheels and the second power transmission means, and which motor (6) can be electively connected to either said first or second power transmission means.

* * * * *